United States Patent [19]

Aubry

[11] Patent Number: 4,759,158

[45] Date of Patent: Jul. 26, 1988

[54] SET OF PREFABRICATED CONSTRUCTION ELEMENTS

[76] Inventor: André Aubry, 9, rue du plan, 2000 Neuchâtel, Switzerland

[21] Appl. No.: 902,118

[22] Filed: Aug. 29, 1986

Related U.S. Application Data

[63] Continuation of Ser. No. 726,343, Apr. 23, 1985, abandoned.

[30] Foreign Application Priority Data

Apr. 24, 1984 [EP] European Pat. Off. ..... 84810193.7

[51] Int. Cl.[4] ..... E04H 1/00

[52] U.S. Cl. ..... 52/79.2; 52/79.3; 52/79.8; 52/79.13

[58] Field of Search ..... 52/79.1, 79.2, 79.3, 52/79.7, 79.8, 79.13

[56] References Cited

U.S. PATENT DOCUMENTS

| | | | |
|---|---|---|---|
| 2,691,291 | 10/1954 | Henderson | 52/11 X |
| 3,201,907 | 8/1965 | Henderson | 52/79.7 X |
| 3,550,334 | 12/1970 | Van Der Lely | 52/79.7 |
| 4,048,769 | 9/1977 | Van Der Lely et al. | 52/79.7 |
| 4,194,339 | 3/1980 | Fisher | 52/79.8 |

FOREIGN PATENT DOCUMENTS

| | | | |
|---|---|---|---|
| 269000 | 2/1964 | Australia | 52/79.7 |
| 2415959 | 8/1975 | Fed. Rep. of Germany | 52/79.7 |
| 2941382 | 10/1981 | Fed. Rep. of Germany . | |
| 423950 | 8/1947 | Italy | 52/79.1 |
| 40866 | 6/1958 | Poland | 52/79.1 |
| 431912 | 9/1967 | Switzerland | 52/79.1 |
| 913841 | 1/1962 | United Kingdom . | |
| 1158708 | 7/1969 | United Kingdom | 52/79.1 |
| 1221158 | 7/1971 | United Kingdom . | |

OTHER PUBLICATIONS

Translation of Italian Patent No. 423,950 of record, copy herein.

*Primary Examiner*—Henry E. Raduazo
*Attorney, Agent, or Firm*—Marks Murase & White

[57] ABSTRACT

The set of prefabricated construction elements comprises a first prismatic element having the form of a box-shaped body containing a bottom floor and a second prismatic element having the form of a box-shaped body with an inclined roof floor. Preferably the elements are made of precast reinforced concrete.

One of the transverse walls of the first element is displaced to the interior, forming thus with the projecting lateral walls a wind shade. The interior of the walls is provided with insulation. According to the climate an external, insulating shell can be fastened to the external walls.

Such a set of precast elements allows an economic fabrication with only two molds, an easy transport by trucks and a very easy and economic assembly on the spot on one hand and the erection of a multitude of different buildings to size on the other hand.

12 Claims, 7 Drawing Sheets

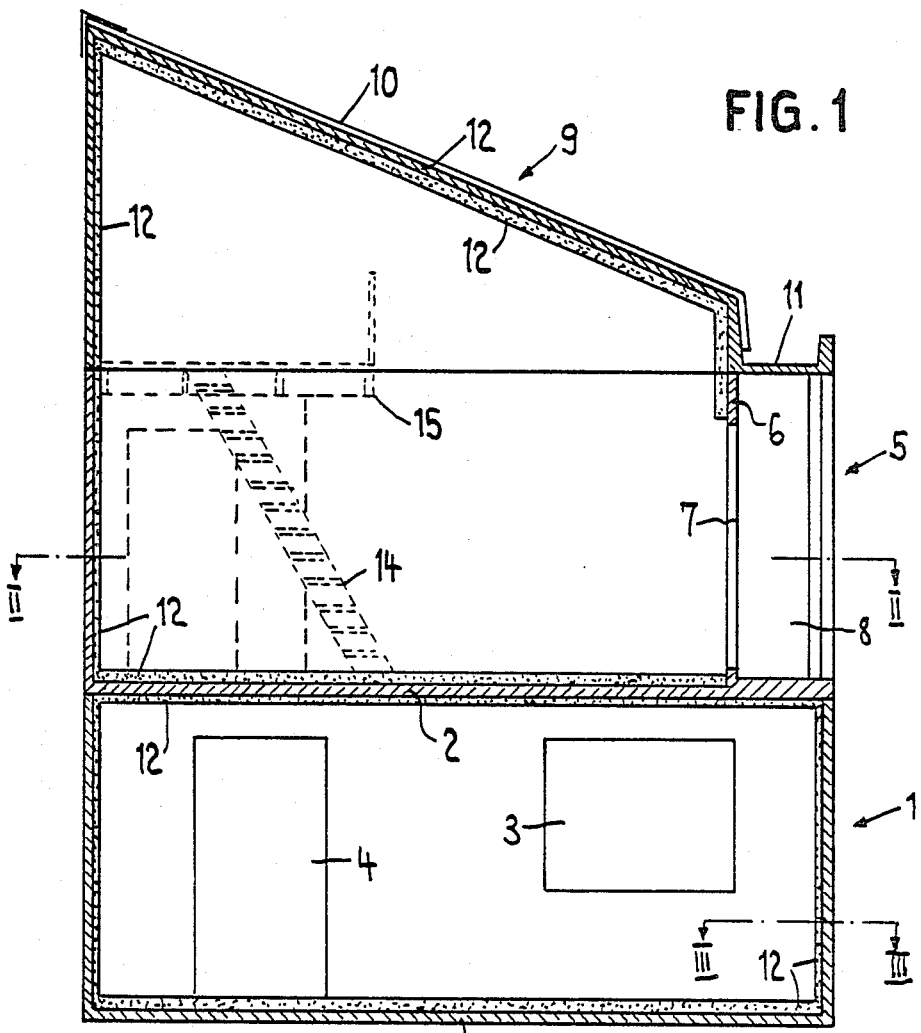
FIG. 1
FIG. 2
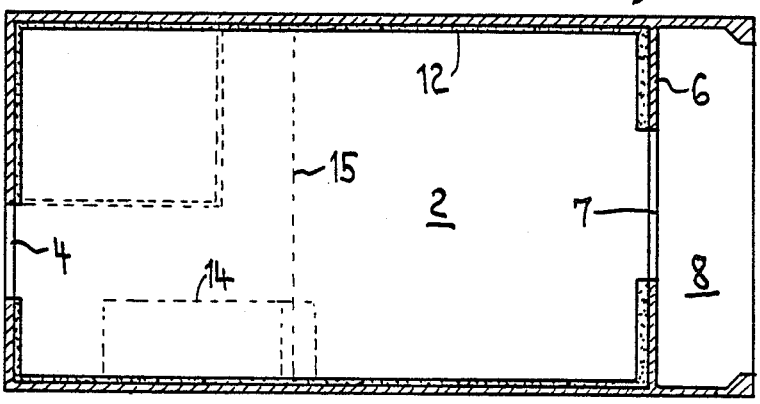
FIG. 3
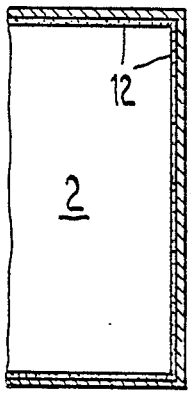

SET OF PREFABRICATED CONSTRUCTION ELEMENTS

BACKGROUND OF THE INVENTION

There exist different manners of realizing constructions with prefabricated construction elements, for example precast car sheds which can be installed on the spot or big buildings where precast or prefabricated walls are used, which are inserted in an appropriate framework. The latter construction method is often more rational than conventional methods, but it is still costly and time consuming and demands high-priced precise construction elements.

U.S. Pat. No. 2,691,291 discloses a building of precast concrete segments which are cast substantially in a horizontal position, than erected in a vertical position and aligned one behind the other. This method is costly as it needs a very precise casting and the design possibilities are rather limited.

British Pat. No. 913,841 discloses a method of constructing a building from precast concrete elements, where a wealth of different elements are shown. This method allows a greater freedom in design but needs many elements which increases considerably the costs for casting and stocking the elements.

It is the object of an present invention to provide a set of prefabricated construction elements which contains few, relatively inexpensive elements allowing design of a multitude of different buildings for habitation, industry, transport, the commerce, touring business, and the educational sector.

SUMMARY OF THE INVENTION

The object is attained with a set of prefabricated construction elements, comprising a first prismatic element having the form of a box-shaped body containing a bottom floor and a second prismatic element having the form of a box-shaped body with an inclined roof floor. Preferably, the elements are made of precast reinforced concrete.

BRIEF DESCRIPTION OF THE DRAWING

FIG. 1 shows a section of three assembled construction elements,

FIGS. 2 and 3 show the ground plan according to the lines II—II and III—III of FIG. 1.

DESCRIPTION OF THE PREFERRED EMBODIMENTS

Figure 4:
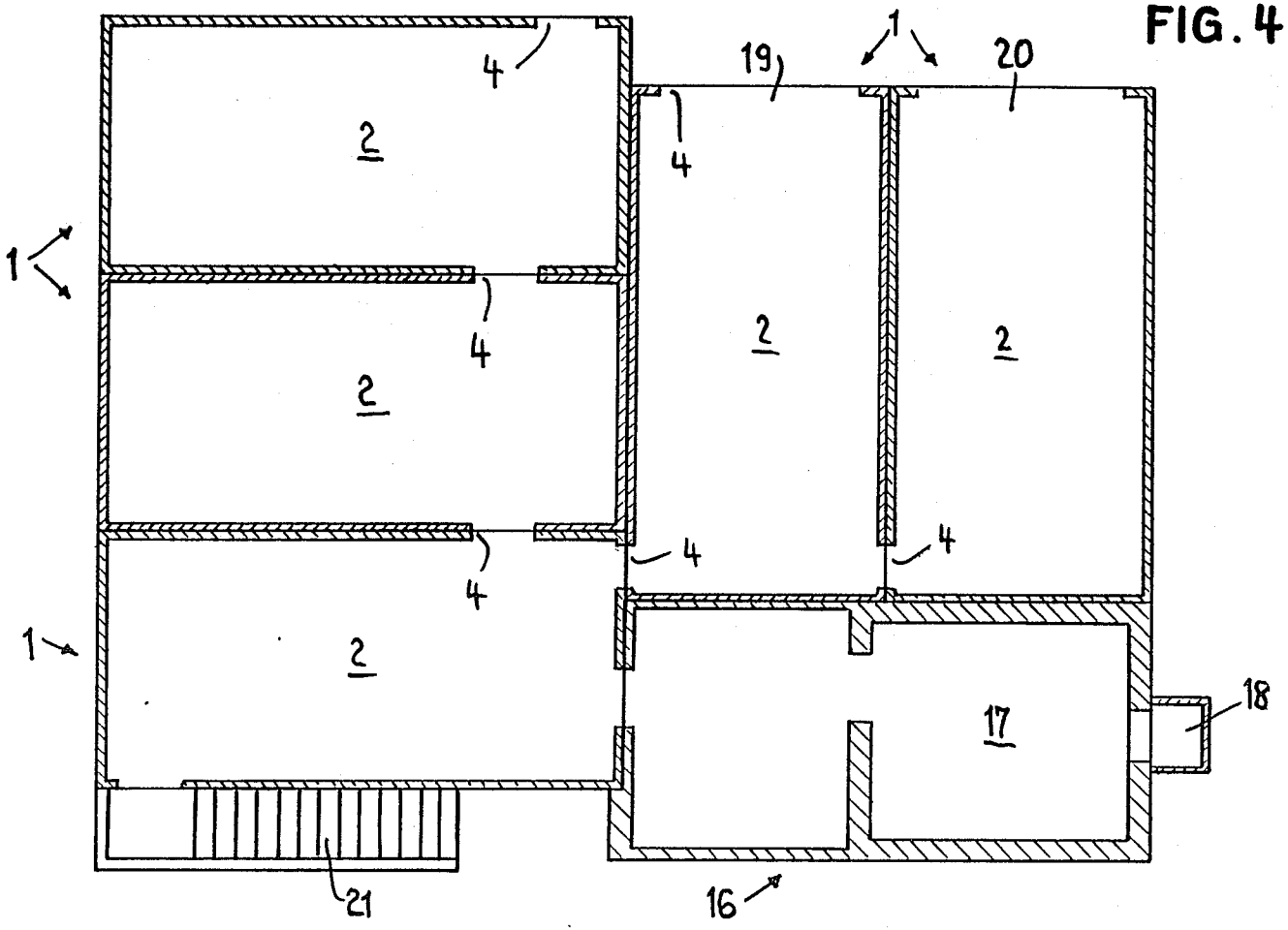
FIG. 4 shows a ground plan of a basement of a house assembled with the set according to the invention.

The set of prefabricated construction elements, made preferably of reinforced concrete, is essentially composed of the elements illustrated in FIGS. 1 to 3, and 13. The first element or room element 1 is disclosed in a sectional view at the bottom of FIG. 1 and as plan in FIG. 3, and is a prismatic element having the form of a box-shaped module containing a bottom floor 2. This box is open towards the ceiling and comprises, in accordance to assigned location, openings 3 and 4 (see FIG. 1) for the windows and the doors. The first embodiment according to FIG. 3 of this element is conceived in the first place for constituting the basement and comprises on all four sides room walls. A second embodiment 5 of this first element is disclosed on top of the other and in FIG. 2. One of the transverse walls 6 is displaced to the interior and comprises, for example, a glass door 7, the projecting parts of the lateral wall forming, for example, a wind shade 8.

Figure 13:
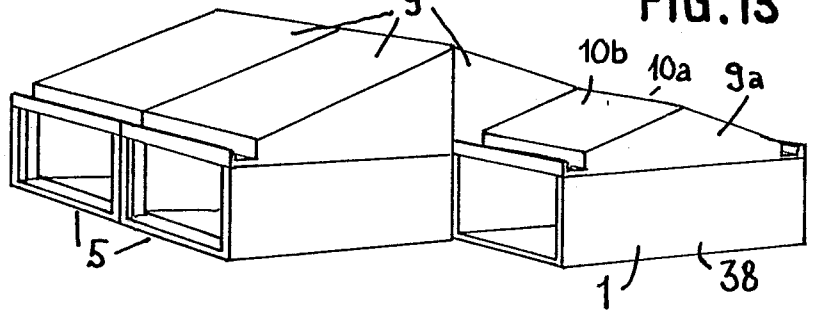
FIG. 13 shows an assembly of houses, with a car shed showing a second embodiment of a roof.

The second element or roof element 9 of the set comprises an inclined roof floor 10, roof walls at the lower side of the roof an incorporated channel 11. In FIG. 13 is shown another embodiment **9*a* of said second element, comprising a roof floor 10*a* which has two inclined parts 10*b*, the height of it being the height at the middle of the roof floor 10** of the first element having only one inclined roof.

Preferably the dimensions of the elements are the following: length 6.30 m, width 3.15 m, the height, without the roof, 2.70 m. Other dimensions are of course possible, and also other materials. The mentioned dimensions are optimized for elements made of reinforced concrete and lead on one hand to reasonably spaced rooms and on the other hand to a clearance and weight which is easily transportable by a truck.

As follows from FIGS. 1 to 3, each element comprises at its interior an insulation 12, said insulation consisting of layers of known insulating materials such as glass fibers, mineral wool, synthetic insulating material like polystyrene in several structures or any other material known to one having ordinary skill in the art. Preferably, the insulation 12 is prepared and fastened at the factory fabricating the elements. It is however possible to construct the insulation in such a manner as to be fastened on the spot to the wall after assembling the building. The interior surface of the insulation can be finished, treated or covered by wallpaper or the like.

Figure 15:
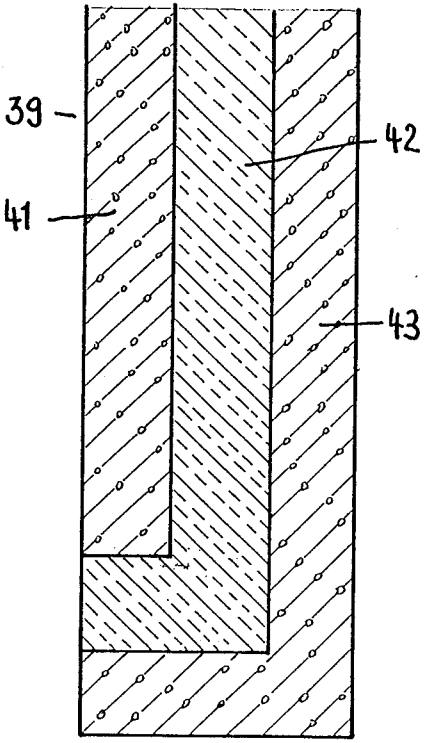
FIG. 15 shows a section of an external, insulating shell for the external walls.

According to FIG. 15 it is also possible to put an insulating external shell 39 on the external wall of the building, said external shell comprising, for example, of an inner layer 41 of concrete or the like, an intermediary layer 42 of insulating material like mineral wool or the like, and an external layer 43 consisting for example also of concrete or any other material like wood or marble. Said external shell can, like the inner insulation, be mounted at the factory or after assembling the building, or also subsequently, any time after finishing the building. For further increasing the insulating effect it is possible to provide, according to FIG. 14, an insulating buffer 40 between the inner part and the outer wind shade part 8 of element 5.

The roof floor 10 can be covered by tiles, slate or any other covering 13. There is further schematically disclosed a staircase 14 and a gallery 15. In FIG. 2 a bathroom and a shower can be seen.

The FIGS. 4 to 7 show, schematically, a residence assembled with the elements described above. FIG. 4 shows the plane of the basement, consisting of five elements 1. If necessary, that is prescribed by the government, an element 16 is constructed on the spot, comprising an air-raid shelter 17 with thicker walls and an emmergency exit 18.

The different elements comprise the necessary sanitary installations such as heating, boiler and others, the plumbing and electrical system, and compartments for the cellar, laundry, drying room, etc. One or two of these elements can be used as car sheds, in this example elements 19 and 20, or 38 in FIG. 13. There is also an external staircase 21.

Figure 5:
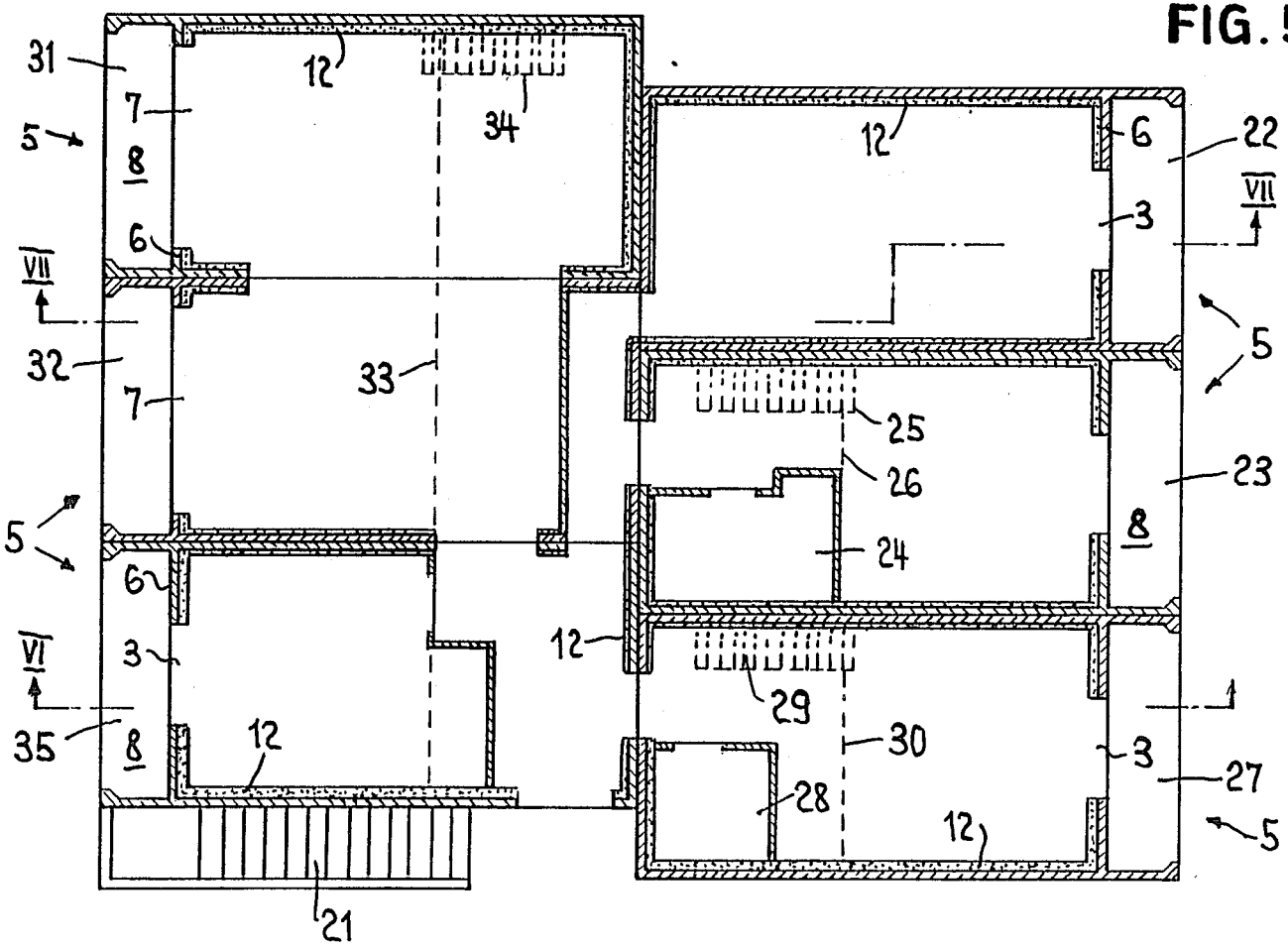
FIG. 5 shows a ground plan of the ground level of the house of FIG. 4.
Figure 7:
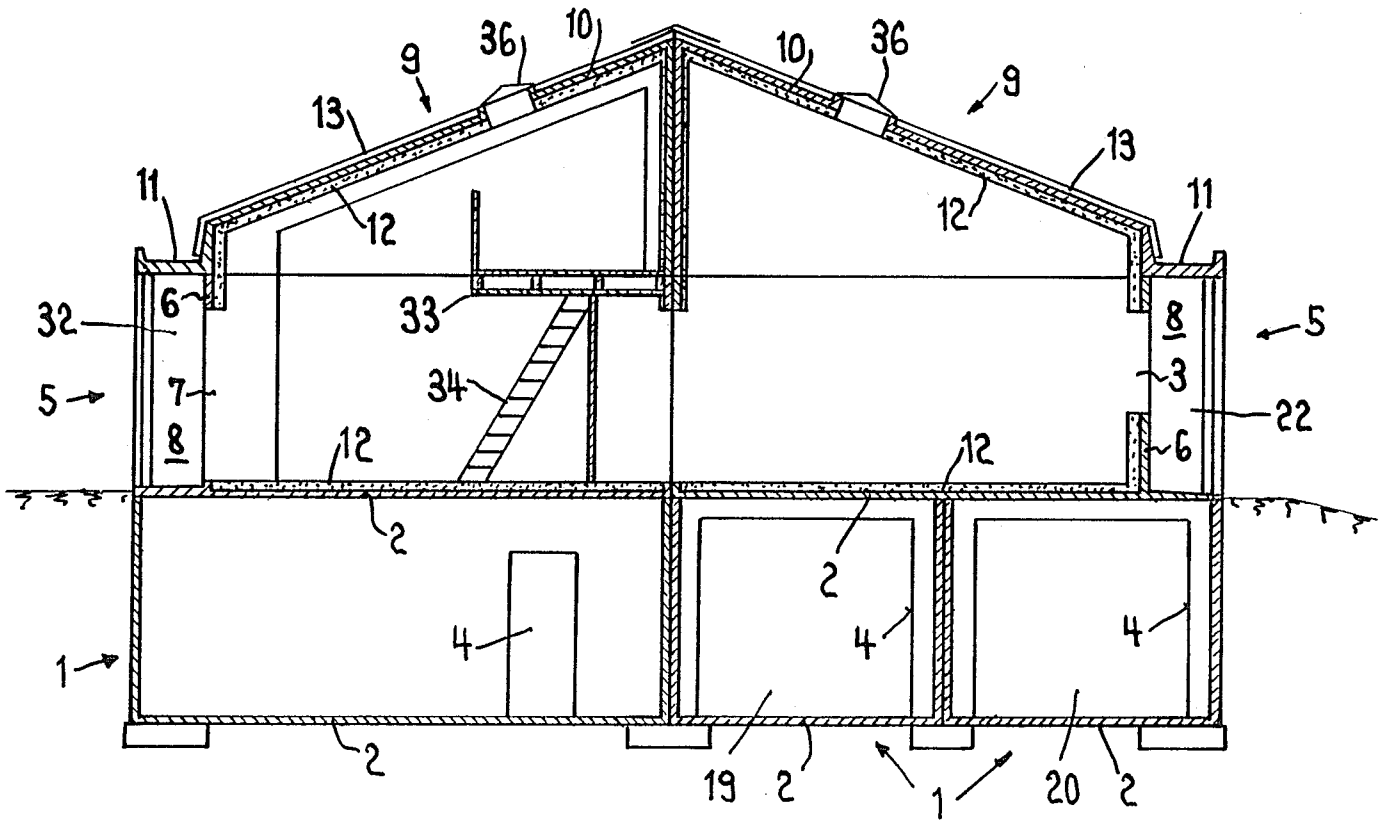
FIG. 7 shows a section according to line VII—VII of FIG. 5, FIGS. 8–12 show schematically different constructions assembled with the set according to the invention.
Figure 11:
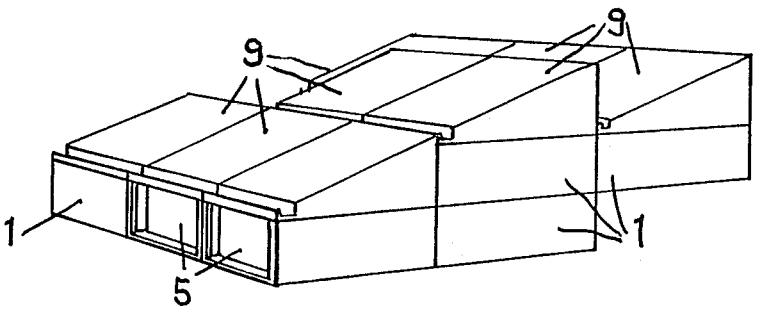
Figure 12:
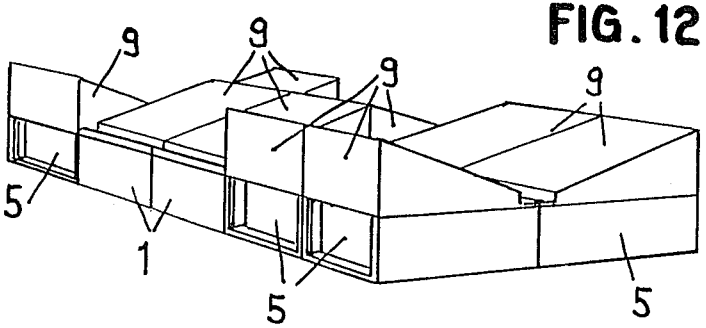
Figure 8:
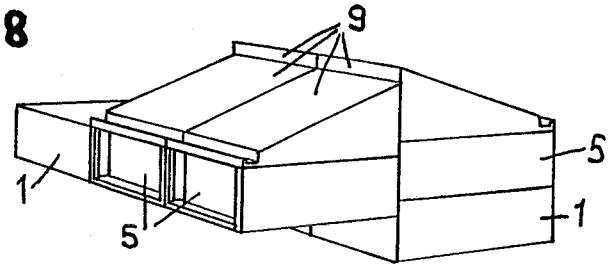
Figure 9:
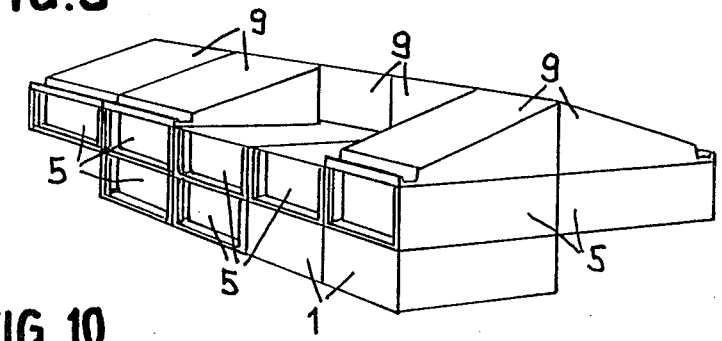
Figure 10:
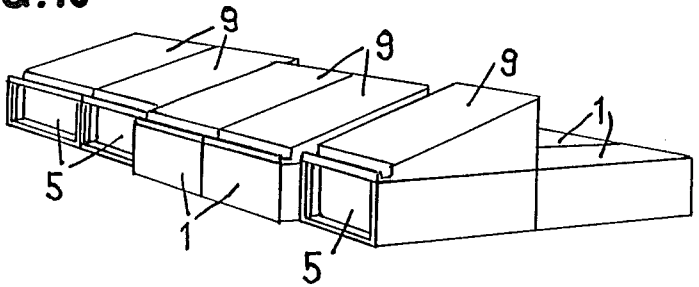

FIG. 5 shows the next floor on top of the basement, that is the ground level. On the upper right side of FIG. 5 there is an element 22 constituting a single room open to the roof, as shown in FIG. 7. Of course, this room could be provided with a ceiling. The intermediate element 23 comprises as example a bathroom 24 and a staircase 25 leading to the gallery 26. In the bottom element 27 a shower 28 has been installed and a staircase 29, leading to the gallery 30. It follows from the above-indicated dimensions that at least one bed can be installed on the gallery.

Figure 6:
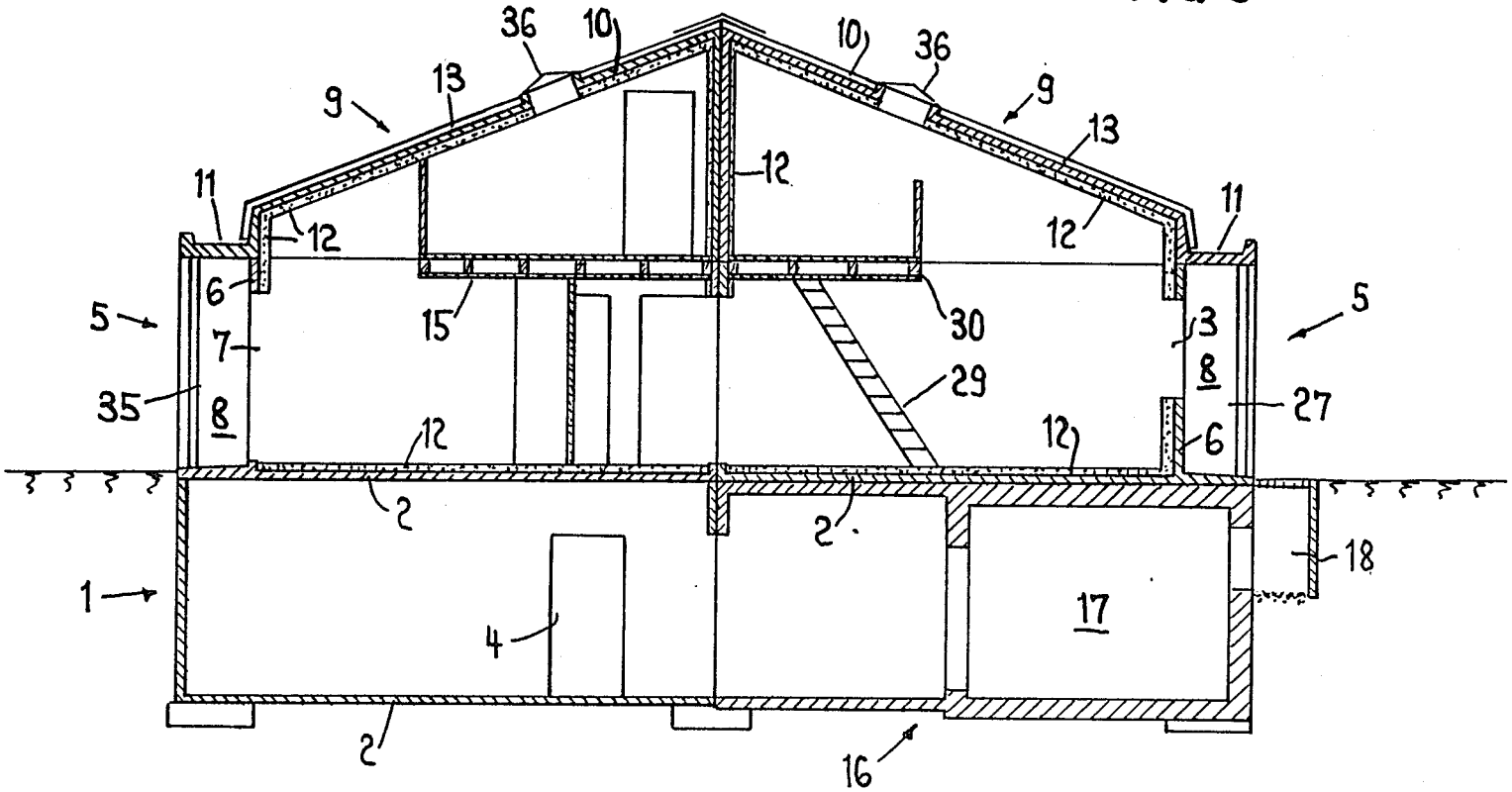
FIG. 6 shows a section according to line VI—VI of FIG. 5.

On the left side of FIG. 5 two elements 31 and 32 have been arranged as a living room with a gallery 33, accessible by the staircase 34. At the bottom there is a kitchen 35 and the rest of the space constitutes a corridor. It can be seen from FIG. 6 that it is advantageous to close the gallery 33 toward the kitchen to prevent odors from the kitchen in the gallery. Thus, it is possible to transform the gallery above the kitchen into a storeroom or the like. Above the gallery the roof is provided with attic windows 36. The sectional view of FIG. 6 shows further the different doors leading into the different rooms.

The example of the residence according to the FIGS. 4 to 7 and 13 to 15 shows the very numerous possibilities of assemblage and equipment of the elements according to the invention. FIGS. 8 to 12 show schematically other examples of assembling different elements, whereby it is shown for example that it is possible to leave out the element with the roof floor at the elements 1 or 5 for forming balconies, either at the corner as in FIG. 8 or either in the middle of the building, as in FIG. 9. It is also seen that it is easy to provide for car sheds by choosing elements designed to serve as such for example according to FIG. 13. The shed-elements are wholly integrated because they comprise the same elements as for the other rooms. It follows also from these figures that it is very easy to build groups of houses which adapt very well to the shape of the ground.

It is possible as well to apply the above-described set of elements for the construction of a building with several floors, for example, 4–5 floors. One floor can comprise twelve elements 1 and one element can be used for the staircase and elevator. This gives for example a flat with 5½ rooms and a flat with 4 rooms on one floor.

As mentioned above it is possible to use materials other than reinforced concrete, as long as it is possible to prefabricate this material. It can be further useful to provide for means for fastening one element to another to increase their mutual adherence. Generally speaking, however, if the elements are made of reinforced concrete, their weight is sufficient to resist any displacement, even in a storm.

Figure 14:
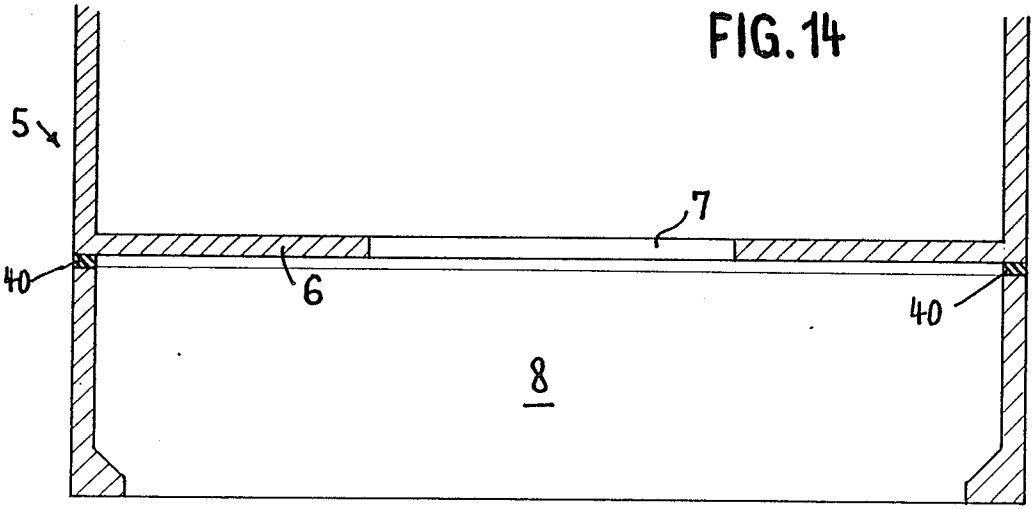
FIG. 14 shows a section of a detail of construction.

As follows from the above description and the dawing that it is possible, if choosing the embodiment of element 5 according to FIG. 14, to use only two molds for producing the elements and hence all the wealth of different buildings. It can be readily seen that the modified roof according to FIG. 13 can be made with the same mold with the addition of only a supplemental insert.

The assemblage of a residence or of any other building is very easy and can be rapidly executed. Once the ground is prepared for receiving the elements they are brought by trucks, one after the other, and then unloaded and piled up with a crane able to lift these elements. It is thus easily possible to assemble the residence described according the FIGS. 4–7 in one day, which is greatly advantageous with reference to other construction systems. In particular the interior of the building is almost immediately sheltered from rain.

It follows that the fabrication of such elements of reinforced concrete is easy and economic, and also that assemblage is easy realizable and needs only few workmen. It follows further that the elements offer a very rational solution to design problems on one hand and very great possibilities of assembling different kinds of habitations and buildings to size. The different insulation means, at the interior, at the outside or between the inner wall and the wind shade allow adaptation of the buildings to the climate of the site.

What I claim:

1. A set of prefabricated construction elements, said set consisting essentially of:

at least one room element having a rectangular bottom floor and four room walls respectively extending substantially transversely from sides of said rectangular bottom floor to form a first and second pair of parallel, opposed room walls, said first pair being spaced a distance 1 apart, and said second pair being spaced a distance w apart, the room walls of one pair being substantially transverse and joined to the room walls of the other pair; and at least one roof element having a roof-floor with two pairs of parallel, opposed sides, a first pair of parallel roof walls extending substantially transversely from one of said pairs of opposed sides and a second pair of parallel roof walls extending at an oblique angle from the other of said pairs of opposed sides to form two pairs of parallel, opposed roof walls, said first pair of roof walls being spaced said distance w apart, and said second pair of roof walls being spaced said distance 1 apart, the roof walls of one pair being substantially transverse and joined to the roof walls of the other pair.

2. A set according to claim 1 wherein one side of the rectangular bottom floor is provided with a longitudinal floor extension laterally co-extensive with said one side, and a pair of room walls substantially transverse to said one side are provided with longitudinal wall extensions in the same direction and to the same extent as said longitudinal floor extensions, to define a wind shade.

3. A set according to claim 2 further comprising an insulating buffer between the room wall extending transversely from said one side and said longitudinal wall extensions.

4. A set according to claim 3, wherein the interior of the elements is provided with insulation, and wherein said roof floor comprises an incorporated channel.

5. A set according to claim 3, wherein the elements are made of precast reinforced concrete, the roof floor comprises an incorporated channel, the interior of the elements is provided with insulation comprising layers of insulating material, and the walls are provided with an external, insulating shell comprising a first layer of concrete, a second layer of insulating material, and a third layer of a material taken from the group consisting of concrete, wood, and marble.

6. A set according to claim 4 wherein said insulation comprises layers of an insulating material taken from the group consisting of glass fibers, mineral wool, and polystyrene material, wherein said walls are provided with an external insulating shell comprising a first layer of concrete, a second layer of insulating material, and a third layer of a material taken from the group consisting of concrete, wood, and marble, wherein said room walls are provided with openings for windows and doors, and said roof floor is provided with an attic window, and wherein said elmenets are provided with separating walls, staircases, galleries, sanitary installations, and a kitchen.

7. A building shell consisting essentially of:

at least one room element having a rectangular bottom floor and four room walls respectively extending substantially transversely from sides of said rectangular bottom floor to form a first and second pair of parallel, opposed room walls, said first pair of room walls being spaced a distance 1 apart, and said second pair of room walls being spaced a distance w apart, the room walls of one pair being substantially transverse and joined to the room walls of the other pair; and at least one roof element having a roof-floor with two pairs of parallel, opposed sides, a first pair of parallel roof walls extending substantially transversely from one of said pairs of opposed sides and a second pair of parallel roof walls extending at an oblique angle from the other of said pairs of opposed sides to form two pairs of parallel, opposed roof walls, said first pair of roof walls being spaced said distance w apart, and said second pair of roof walls being spaced said distance 1 apart, the roof walls of one pair being substantially transverse and joined to the roof walls of the other pair.

8. A shell according to claim 7, wherein one side of the rectangular bottom floor is provided with a longitudinal floor extension collateral with said one side, and a pair of room walls substantially transverse to said one side are provided with longitudinal wall extensions in the same direction and to the same extent as said longitudinal floor extensions, to define a wind shade.

9. A shell according to claim 8, further comprising an insulating buffer between the room wall extending transversely from said one side and said longitudinal wall extensions.

10. A shell according to claim 9, wherein the interior of the elements is provided with insulation, and wherein said roof floor comprises an incorporated channel.

11. A set according to claim 9, wherein the elements are made of precast reinforced concrete, the roof floor comprises an incorporated channel, the interior of the elements is provided with insulation comprising layers of insulating material, and the walls are provided with an external, insulating shell comprising a first layer of concrete, a second layer of insulating material, and a third layer of a material taken from the group consisting of concrete, wood, and marble.

12. A set according to claim 10, wherein said insulation comprises layers of an insulating material taken from the group consisting of glass fibers, mineral wool, and polystyrene material, wherein said walls are provided with an external insulating shell comprising a first layer of a material taken from the group consisting of concrete, wood, and marble, wherein said room walls are provided with openings for windows and doors, and said roof floor is provided with an attic window, and wherein said elements are provided with separating walls, staircases, galleries, sanitary installations, and a kitchen.

* * * * *